United States Patent [19]

Boccalon et al.

[11] Patent Number: 4,832,990

[45] Date of Patent: May 23, 1989

[54] PROCESS FOR COATING METAL SURFACES WITH POLYOLEFINS

[75] Inventors: Gianfranco Boccalon; Alberto Pelacani, both of Monterotondo; Giuseppe Tigani, Rome; Aldo Brancaccio, Cremona, all of Italy

[73] Assignees: Eniricerche S.p.A., Milan; Enichem Anic S.p.A., Palermo, both of Italy

[21] Appl. No.: 127,795

[22] Filed: Dec. 2, 1987

[30] Foreign Application Priority Data

Dec. 11, 1986 [IT] Italy ..... 22639 A/86

[51] Int. Cl.[4] ..... B05D 5/02

[52] U.S. Cl. ..... 427/388.1; 264/135; 428/447; 428/448; 428/450; 148/6.14 R

[58] Field of Search ..... 148/6.14; 427/388.1; 156/244.33, 244.27; 264/135; 428/447, 448, 450

[56] References Cited

U.S. PATENT DOCUMENTS 4,546,125 10/1985 Okamoto ..... 526/323.2

4,654,236 3/1987 Finzel ..... 148/6.14 R

*Primary Examiner*—Sam Silverberg

*Attorney, Agent, or Firm*—Hedman, Gibson, Costigan & Hoare

[57] ABSTRACT

A tough and long-lasting adhesion of polyolefins to metal substrates is realized by means of a process comprising the following four process steps, carried out in succession:

(a) mechanical cleaning of the metal surface;

(b) treatment of the metal surface with a water-alcohol solution containing at least an alkoxysilane and boric acid;

(c) thermal treatment of the surface coming from the (b) step;

(d) treatment of the so-treated surface with a polyolefin based composition, containing zeolites and carbon black.

24 Claims, No Drawings

PROCESS FOR COATING METAL SURFACES WITH POLYOLEFINS

The present invention relates to a process by means of which a metal substrate is coated with a polyolefin based material in such a way as to produce a strong and long-lasting adhesion to the same substrate.

Such process makes it possible to obtain both protective coatings for flat metal surfaces, and coatings of tubular manufactured articles. It makes it furthermore possible to prepare manufactured articles having a composite structure, constitued by at least two metal layers, equal to, or different from, each other, firmly bonded by adhesion by intermediate layers of the above said polymeric material.

The polyolefins, such as, e.g., polyethylene, are attractive as materials for corrosion-proof protective coatings. They offer the advantage of a low cost, and of a great chemical inertness; but the adhesion of such materials to metals results extremely poor, and affected by a short life. This drawback is commonly thought to be due to the formation of a weak-adhesion layer at the metal-polymer interface, with a consequent easy mechanical failure of the bond.

In addition, the chemical incompatibility between the non-polar polyolefin and the surface of the substrate, having a strongly polar nature, does not allow the polymer and the substrate to come into an intimate contact with each other. The polymer in the molten state is indeed unable to wet the substrate, thus the necessary condition for strong adhesive bonds to be formed being not complied with.

In practice, the obtained adhesion is affected by a set of limitations: the metal-polymer bond does not withstand, e.g., the dipping in water, it does not withstand ageing, and shows an easy detachment when a cathodic protection is applied to the metal.

In order to improve the adhesion of polyolefins, and, in particular, of polyethylene, to metal substrates, various treatments of the metal surface before the application of the polymeric substrate are known and used.

Japan Pat. No. 58/043,268 proposes to pretreat a steel surface with a calcium or zinc phosphate, and to apply, after that, a second treatment with a titanium organometallic compound.

In Japan Pat. No. 57/113,871, on the contrary a treatment is disclosed, with a system constituted by chromic acid and phosphoric acid, to be applied after an accurate cleaning of the same surface.

In U.S. Pat. No. 3,466,207, a treatment is furthermore disclosed, of the metal substrate with an aqueous solution of an aliphatic carboxy acid, then followed by a further treatment with an acidic solution containing hexavalent chromium.

These pretreatments improve the corrosion resistance of the surface, but result poorly efficacious in improving the resistance of metal-polymer bonds to the detachment agents.

An improvement in the resistance to the action of the detachment agents, in particular to the cathodic detachment, is obtained by interplacing an adhesion promoter between the polymeric coating and the substrate. A type of adhesion promoter is constituted, e.g., by aminoalkyl-silanes (U.S. Pat. No. 3,088,847); other adhesion promoters are accomplished by means of an adhesive layer generally constituted by a resin obtained by copolymerizing ethylene with polar comonomers, such as acrylic acid and vinyl acetate.

These types of coatings, using a resin as the adhesive intermediate layer, are disclosed, e.g., in Japan No. 58/051,130, Japan No. 60/245,544, Japan No. 58/107,333, U.S. Pat. No. 4,407,893, EP 81,040, DE 3,422,920 patents.

However, these adhesives, on such substrates as iron or carbon steel, do not guarantee a long-lasting adhesion, due to possible reactions of the metal with the acidic moieties of the comonomers present in the resin, in particular in the presence of moisture.

Reactions of this type, in fact, promote corrosion processes, in particular whenever a defect in the application of the coating, or a crack, occurs.

Furthermore, these double-layer coatings do not fully meet the requirements of resistance to the cathodic detachment, as required, e.g., for the pipes for methane pipelines according to ASTM G8 Mehod B standards.

In the art, also known is the use of a third layer based on epoxy resins, i.e., a primer, applied on steel; between this primer and the external polyethylene coating, the presence of an intermediate layer of an adhesive based on olefinic copolymers is always necessary.

This type of three-layer coating is disclosed, e.g., in Japan No. 59/150,575; Japan No. 59/078,834; Japan No. 57/113,871; EP No. 57,823; EP No. 153,816 patents.

Even if the characteristics of this last type of coating are better than as obtained, e.g., by means of a double coating, or by a simple treatment of the surface, as hereinabove disclosed, it is evident that such a three-layer coating results rather complex and expensive from the standpoint of the industrial use.

Furthermore, the three regions of interface between different materials are all regions of preferential occurrence of faults and failures, which can occur during the preparation of the coated articles, or during their transportation, or during their use.

In the art, also coatings of metal surfaces are known, which do not provide for the metal surface pretreatment to be carried out, or an adhesive, or a primer, to be interplaced.

For example, in U.S. Pat. No. 4,487,810 patent, an adhesive polymeric composition is disclosed, which is based on polyethylene and zeolites, in the acidic form, to be directly applied onto the metal surface without any preliminary treatments of this latter.

The obtained adhesion is good for such a metal as aluminum but results unsatisfactory on ferrous materials.

The present Applicant has found now that the drawbacks deriving from the prior art can be overcome and metal surfaces, in particular iron and steel, can be coated with a polyolefin-based composition, containing zeolites and carbon black, with a strong and long-lasting adhesion being obtained in a simple and cheap way.

In particular, according to the present invention, the metal surface is coated by means of a process comprising the following steps, carried out in succession:

(a) mechanical cleaning of the metal surface;

(b) treatment of the metal surface with a water-alcohol solution containing boric acid, and at least an alkoxysilane having the formula:

$$R_n—Si(OR^1)_m$$

wherein:

$R^1$ is a linear or branched alkyl radical containing from 1 to 4 carbon atoms, R is a linear or branched, saturated or unsaturated, possibly substituted hydrocarbon radical containing from 1 to 5 carbon atoms, $m+n=4$, and m is always different from zero;

(c) thermal treatment of the so treated surface, wherein said thermal treatment takes place at a temperature comprised within the range of from 60° to 250° C., for a time of from 1 minute to 2 hours;

(d) coating of the so-treated surface with a poliolefin-based composition, containing zeolites and carbon black.

The metal surface to be coated can be aluminum, iron, steel, titanium, zinc, and it is preferably iron or steel.

The cleaning of the metal surface can be carried out by means of one of the following mechanical abrasion methods (blasting):

(1) by using sand;

(2) by using corundum powder;

(3) by using metal grit.

In all of said three cases, the cleaning treatment is continued until a metal surface of silvery appearance is obtained, which relates to a finishing degree of at least SA2 1/2, or higher, according to SVENSK Standard SIS 055900 (1967). The so-cleaned metal surface is then submitted to the treatment of the (b) step, which is indicated hereinunder by the term "boron-silanizing treatment".

The solution which is used to that end, a solution which will be denominated as the "boron-silanizing" solution, is a solution which is obtained by mixing, at room temperature (20°-25° C.), boric acid, and at least an alkoxy-silane meeting the hereinabove exposed formula, in a water-alcoholic solvent, the alcohol being either ethanol or methanol.

Some examples of alkoxy-silanes used according to the present invention are tetra-ethoxy-silane (TES), triethoxy-vinyl-silane, tri-methoxy-methyl-silane and, preferably, tetra-ethoxy-silane is used.

The boric acid can be added to the solution as such, or an ester thereof, such as, e.g., tri-butyl-borate, which is hydrolized, to yield the acid, by water present in the solution, can be used.

The boron-silanizing solution according to the present invention is characterized in that it contains an amount of boric acid comprised within the range of from 1% by weight up to the amount allowed by the solubility limit, and, preferably, of from 1% to 4.8% by weight, and an amount of alkoxy-silane comprised within the range of from 2% to 20%, and preferably of from 2% to 5%, the B/Si molar ratio being comprised within the range of from 1/1 to 3/1.

The solution pH can have values comprised within the range of from 3 to 7, with the preferred range being of from 5 to 6.

Before that the solution, prepared as above, can be used, it must be left standing to age at room temperature (20°-25° C.) for a time of from 0.5 to 3 hours, and, preferably, of from 1 to 2 hours. By operating under such conditions, the hydrolysis of only one of the alkoxy groups bound to silicon probably occurs.

The boron-silanizing treatment of the metal surface consists in wetting the same surface with the water-alcoholic solution prepared as above diclosed.

In practice, the metal surface is wetted either by dipping said metal surface into the solution, or by spraying the solution onto said surface by means of an atomizer.

Once wetted, the surface must be submitted to a thermal treatment at a temperature comprised within the range of from 60° to 250° C., for a time comprised within the range of from 1 minute to 2 hours, and, preferably, at a temperature comprised within the range of from 120° to 180° C., for a time of from 5 minutes to 1 hour, according to the temperature.

According to the process of the present invention, the boron-silanized metal surface, coming from the (c) step, is coated with a polymeric composition, containing an inorganic, silica-based filler, preferably a zeolite, and carbon black.

Among the used polyolefins, polyethylene, in particular, low-density polyethylene, is preferred.

The polymer can contain additives, such as antioxidants, in such amounts as they are generally contained in the commercial polymers.

The zeolite, according to the present invention, can be both of natural and synthetic origin, and must contain, after dehydration and calcination, a water content not larger than 8% by weight, and a granulometry not larger than 4 microns.

Some examples of useful zeolites according to the present invention are:

(1) Synthetic zeolites, of Faujasite type, known as zeolites of "X" type and of "Y" type. Among these, preferred is the "13X" type, commercially available from Union Carbide, under the commercial name "ZB-300", or also Linde 13X.

(2) Zeolites of "A" type, and, among these, preferably the zeolites of 4A type, commercially available from Union Carbide Linde Division, under the commercial name Linde 4A.

(3) Zeolites of Mordenite type, sodium, lithium, calcium alumino-silicates, or sodium and magnesium mixed alumino-silicates, with an $SiO_2/AlO_2$ ratio comprised within the range of from 2 to 5.7, commercially available from Norton Chemical Process Products under the trade name Zeolon.

(4) Zeolites of ZSM type, alumino-silicates and synthetic materials, on the basis of silica co-crystallized with metal oxides with amphoteric character, besides aluminum, such as berillium, boron, titanium, vanadium, chromium, iron, manganese, zirconium, antimony.

After being thoroughly dried by calcination up to 550° C., the zeolite is dispersed throughout the polymeric matrix by means of one of the traditional methods known from the art of polymer processing technology, by using, e.g., a cylinder mixer, or a closed-chamber mixer.

The preferred procedure is that wherein use is made of a closed mixer of Banbury type (the "master batch technique"), wherein the dry zeolite is added to the polymer in the molten form; the homogenized mass is then extruded and cut into granules.

The carbon black used in the preparation of the adhesive polymeric compositions according to the present invention can be selected from those types which are commonly used as fillers for organic polymers. Its presence is not essential, but contributes to increase the adhesion strength of the bond.

It is of basic importance that the carbon black to be charged is free from moisture, and it must be therefore preliminarily dried. It can be charged by means of the "master batch technique" as hereinabove disclosed, or it can be intimately mixed with the anhydrous zeolite by means of a ball mill. The powder which is obtained in then mixed with the polymer, maintained in the molten state, thus the desired adhesive polymeric composition being obtained.

According to a preferred form of practical embodiment, zeolites and carbon black can be mixed with each other by operating in aqueous suspension in the presence of a surfactant. The obtained slurry, dried and calcined up to 400° C. is ready to be added to the polymer.

The adhesive polymeric compositions according to the present invention contain from 0.1 to 40% by weight of zeolite and from 0 to 6% by weight of carbon black.

In the uses as protective coatings, preferably polymeric compositions are used, which contain from 4 to 10% by weight of zeolite, and from 1.8% to 3.5% by weight of carbon black.

In the uses as structural adhesives, the polymeric compositions preferably contain from 4 to 40% by weight of zeolites, and the contained amount of carbon black is preferably comprised within the range of from 3% to 6% by weight.

The adhesive composition can be applied onto the metal surface by using any of the methods known from the prior art. In case obtaining a protective coating is desired, the polymeric mass, to which zeolites and carbon black are added, cut in the form of granules, can be used to feed a flat-die extruder, with the surface to be coated being maintained at a temperature higher than 150° C., and preferably higher than 175° C.

Such a technique, known as the "extrusion coating technique", can be applied both to flat substrates, and to tubular articles, preliminarily treated as above disclosed, with coatings of a thickness typically comprised within the range of from 2 to 4 mm being obtained.

Another used technique, also useful to glue different metal parts to each other, is the lamination technique.

According to such technique, the polymeric composition is applied to the substrate to be coated, or is interposed between the metal surfaces which have to be glued to each other, in the form of a sheet having a thickness comprised within the range of from 0.2 to 4 mm, with a pressure higher than 1 kg/cm$^2$ being applied, and with the system being heated to a temperature comprised within the range of from 175° C. to 250° C., for a time of from 5 to 15 minutes, so that the molten polymer completely wets the metal surface.

The process of coating a metal surface with a polyolefin, according to the present invention, gives the same coating a strength in adhesion and a duration over time which are considerably better than known from the prior art.

The used process, besides being extremely simple and practical, is also economically favourable, and is therefore suitable for an industrial application in many sectors.

A further advantage is constituted by the fact that the coating of the present invention makes it much easier and simpler to control the homogenuty of the adhesion, even on large surface areas.

The following examples have to be considered as illustrative and not limitative of the purview of the same invention.

EXAMPLE 1

1,000 g of crystals of zeolite of 13X type (commercially available as Linde 13X, marketed by Union Carbide) was sieved such to remove the fraction with a granulometry larger than 4 microns. The so-obtained powder is thoroughly dried by calcination at 450° C., with a weight loss of 18%.

In that way, the obtained powder contains a water amount smaller than 8% by weight.

400 g of crystals coming from calcination was intimately mixed with a matrix of 600 g of commercial polyethylene (Eraclene C90, density=0.919 g/ml, M.F.I. =7.56), using a closed mixer of Banbury type.

The homogenizing was carried out by maintaining the polymer is the molten state at 150° C., and portionwise adding the anhydrous zeolite, during an addition time of 5 minutes. Thus, 1,000 g was obtained of master batch containing 40% by weight of 13X zeolites; such master batch is defined as "X Master".

If, instead of 13X zeolites, zeolites of 4A type are used (commercially available from Union carbide as Linde 4A), a master batch is obtained, which is denominated "A Master", and contains 40% by weight of 4A zeolite.

The master batches obtained after the homogenizing are cooled in a closed chamber under a nitrogen stream, and are finally cut into granules.

EXAMPLE 2

To a mixer containing 872 g of low-density polyethylene (Riblene, density 0.927 g/ml, M.F.I. =2) in the molten state, 26.25 g of Vulcan P carbon black is added.

After homogenizing for 10 minutes, 125 g of "X" Master is added, and the mass is homogenized for a further 5 minutes, thus a mass being obtained, which contains 5% by weight of 13X zeolite and 2.6% by weight of carbon black.

EXAMPLES 3 TO 7

By using the "A" Master prepared as disclosed in Example 1, and following the same procedure as of Example 2, an adhesive mass is prepared, which contains 5% by weight of 4A Zeolite, and 2.6% by weight of carbon black (Example 3).

In order to carry out a comparison, the following polymeric compositions, based on polyethylene, are furthermore prepared:

Example 4-Adhesive mass composed by:
87.2% of Riblene polyethylene;
7.5% of Eraclene polyethylene;
2.6% of Vulcan P carbon black.

Example 5-Adhesive mass composed by:
87.2% of Riblene polyethylene;
7.5% of Eraclene polyethylene;
5% of 13X zeolite.

Example 6-Adhesive mass composed by:
87.2% of Riblene polyethylene;
7.5% of Eraclene polyethylene;
5% of 4A zeolite.

Example 7-Adhesive mass composed by:
92.5% of Riblene polyethylene;
7.5% of Eraclene polyethylene.

EXAMPLE 8

1.2 g of neutral surfactant Triton X 100 is dissolved in 800 ml of distilled water.

To this solution, 60 g of Vulcan P carbon black is added. The so-obtained solution is maintained intensely stirred for 30 minutes.

At the end of this time, 240 g is added of Zeolite 4A, and subsequently, with the suspension being kept stirred by means of a blade mixer, the temperature is increased up to 90° C., the evaporation of the solvent being thus favoured, until a slurry is obtained.

The so-obtained viscous mass is dried, firstly at 120° C. for 18 hours in a forced-circulation oven, and then at 180° C. for 3 hours. The drying is completed at 300° C. for 3 hours, and then at 350° C. for 1 hour, under vacuum.

A black powder is thus obtained, which consists of 20% by weight of carbon black, and of 80% by weight of 4A zeolite.

100 g of such powder is charged to a closed mixer, together with 900 g of Riblene polyethylene.

The homogenization is carried out at the temperature of 150° C., for a time of 10 minutes.

At the end, an adhesive mass is obtained, which is constituted by 90% of Riblene, 8% of 4A zeolite, 2% of Vulcan P carbon black.

EXAMPLE 9

80 g of 13X zeolite, previously dried as disclosed in Example 1, is mechanically mixed inside a closed vessel, together with 20 g of Vulcan P carbon black.

The mixture is then transferred to a corundum-ball mill, and is homogenized for 30 minutes. At the end of this time, the powder is transferred to a closed mixer, and is mixed with 300 g of Riblene polyethylene at the temperature of 15° C.

The so obtained adhesive mass has the same composition as of Example 8.

EXAMPLE 10

To 560 g of ethanol at 9.35%, 24.19 g (0.116 mol) of tetra-ethoxy-silane is added with mild stirring.

After the completion of the mixing, 390 g is added of distilled water, and then 13.3 g (0.215 mol) of boric acid is added with mild stirring.

The so obtained solution has a pH of 5.2, and is left standing 1 hour at room temperature (15°–25° C.) before being used to treat the metal surface to be coated with an adhesive mass.

EXAMPLE 11

9 g (0.047 mol) of tri-ethoxy-vinyl-silane is dissolved in 255 g of absolute ethanol, and to this solution 12 g of tri-butyl-borate (0.10 mol) is added.

With the temperature of the solution being kept at 15° C., 24 g of distilled water is then slowly added, with mild stirring.

The stirring of the solution is continued for 1 hour, so that the temperature returns down to room values.

EXAMPLE 12

6 g (0.028 mol) of tetra-ethoxy-silane and 6 g (0.44 mol) of tri-methoxy-methyl-silane is dissolved in 253 g of methanol. To this solution, 24 g of distilled water and 7.5 g (0.12 mol) of boric acid are then added.

The solution is left standing 2 hours at room temperature before that it can be used.

EXAMPLE 13

Two solutions, having the following compositions, are prepared:

(1)
253 g of methanol;
7.5 g of boric acid (0.12 mol);
100 g of water.

(2)
560 g of ethanol;
24.2 g of tetra-ethoxy-silane (0.12 mol).

The two solution are separately stored, and one hour before use they are combined to form one single solution.

EXAMPLE 14

From a sheet of carbon steel (of AQ34 type), of 2 mm of thickness, a set of specimens of 150 mm×250 mm of size were cut.

A portion of these specimens were cleaned by means of sand-blasting ("A" Method), another portion were cleaned by blasting with a corundum powder having a granulometry of 230 mesh ("B" Method), and a third portion thereof ere cleaned by using a metal grit ("C" Method).

In all of said three cases, the cleaning treatment was continued until a metal surface of silvery appearance was obtained, relating to an SA2 1/2 finishing degree according to SVENSK Standard SIS 055900 (1967).

The so cleaned specimens were treated with the solutions from Examples 10, 11, 12, by using a dip-coating technique.

The specimens were therefore dipped into the solutions at the temperature of 20°–25° C., and were then removed from the solution with a removal speed of 2.5 cm/second.

The specimens were then dried for 5 minutes with a nitrogen stream, and were then maintained 8 minutes at 180° C. in oven.

EXAMPLE 15

In this Example, the treatment of the specimens from Example 14 with the boron-silanizing solutions of Examples 10, 11, 12 and 13, by means of the spray-coating method, is disclosed.

According to this method, on the specimens maintained at 90° C. by means of a heating plate, the boron-silanizing solution was sprayed.

In order to spray the solution, an atomizer is used, operating at a flow rate of 18 g of solution per minute, and the painting time is of 10 seconds per each specimen.

After the application of the boron-silanizing solution, each specimen was placed inside an oven maintained at 180° C., and for a time of 5 minutes.

EXAMPLES 16–24

From each one of the adhesive masses containing 13X zeolite, sheets of (120×200×2) mm were obtained by means of compression moulding, at 150° C., between Mylar films, in order to prevent them from sticking to the mould.

Each sheet was then placed on the respective steel specimens, pretreated as disclosed in Examples 14 and 15.

After covering the free surface of the polymer with a Mylar sheet, each specimen was submitted to press-moulding at 185° C., for 8 minutes, such to obtain a coating having a thickness of 2 mm.

The adhesion of the coating to the substrate was measured according to a peeling test at 90° C. (DIN 30670 Method).

On the specimens, a cut was made, through the whole thickness of the coating, up to reach the metal, such to obtain a strip of 2.5 cm in width, and, by using a dynamometer, the test of peeling of the strip of coating was carried out, with a peeling angle of 90° being maintained, and with a constant peeling rate of 0.1 cm/minute.

The adhesion values are reported in the Tables, expressed as the normalized peeling strength per unit of width of the strip of peeled-off coating.

The obtained data is collected in Table 1, wherein also the type of substrate treatment is shown.

For comparison purposes, on the same Table also the adhesion values are reported, which were obtained with adhesive masses not containing zeolites (Examples 4 and 7) on a boron-silanized substrate, and also with adhesive masses complete with all of their constituents, but with the boron-silanizing treatment of the substrate being omitted.

TABLE 1

| | Adhesive mass (Example) | Boron-Silanizing Solution (Example) | Method Used To Clean the Substrate | Adhesion (kg/cm) | Failure of the Bond |
|---|---|---|---|---|---|
| EXAMPLE 16 | 2 | 11 | A | 12.2 | Failure in the adhesive mass |
| EXAMPLE 17 | 2 | 12 | B | 9.3 | " |
| EXAMPLE 18 | 2 | 10 | C | 11.9 | " |
| EXAMPLE 19 | 9 | 10 | A | 12.0 | " |
| EXAMPLE 20 | 5 | 10 | A | 9.7 | " |
| EXAMPLE 21 | 4 | 10 | A | 1.2 | Failure at the interface |
| EXAMPLE 22 | 5 | none | A | 1.1 | " |
| EXAMPLE 23 | 2 | none | A | 1.4 | " |
| EXAMPLE 24 | 7 | 12 | B | 0.8 | " |

EXAMPLES 25 TO 30

The adhesive masses of Examples 2, 3, 6 and 8, containing a 4A zeolite and, for comparison purposes, the adhesive masses of Examples 4 and 7, all of them being cut into granules, were used for feeding an extruder equipped with a flat die, such to obtain coated specimens by means of an extrusion-coating process.

Therefore, the sheets of substrate, suitably cleaned and boron-silanized according to the spray technique, as disclosed in Example 15, are maintained at 180° C., by being kept in contact with a heating plate, and on them an extruded sheet of adhesive polymer of 120 mm of width is laid, with a speed of 32 cm/minute.

The temperature of the extruded sheet was pre-fixed at 178° C.

During the extrusion, on the coating a moderate pressure is applied by means of a roller, such to obtain an end coating of 120 mm of width, and 2.5 mm of thickness.

The samples were then maintained at 180° C. for 3 minutes, and, at the end, were then let cool in air.

In Table 2 the adhesion data is reported, which was obtained by the peeling method at 90° C., on substrates treated with the boron-silanizing solutions of Examples 10 and 13.

The results are compared to those obtained on specimens wherein the boron-silanizing treatment was omitted, or wherein zeolite is absent.

TABLE 2

| | Adhesive mass (Example) | Boron-Silanizing Solution (Example) | Method Used To Clean the Substrate | Adhesion (kg/cm) | Failure of the Bond |
|---|---|---|---|---|---|
| EXAMPLE 25 | 3 | 10 | A | 11.0 | Failure in the adhesive mass |
| EXAMPLE 26 | 3 | 13 | B | 10.5 | " |
| EXAMPLE 27 | 8 | 10 | A | 6.5 | " |
| EXAMPLE 28 | 6 | 10 | B | 9.7 | " |
| EXAMPLE 29 | 3 | none | A | 1.6 | Failure at the interface mass |
| EXAMPLE 30 | 6 | none | B | 1.2 | Failure at the interface |

EXAMPLES 31 TO 36

The specimens of Examples 16, 17 and 20 were submitted to the test of cathodic peeling, carried out according to BS. 3900 Standard (Examples 31, 32, 33).

The test consisted in making a bore of 3 mm of diameter on the coating of the specimens, such to remove a circular portion of coating, and uncover the underlying metal.

On the specimen, by glueing onto the coating, a cylindrical cell of 50 mm of diameter is then fastened, which is filled with a solution at 3% of sodium chloride in distilled water.

To the iron, a cathodic potential is then applied, which is constantly equal to −1.5 V, and the reference electrode is a calomel electrode. The cell is maintained at a temperature of 21° C.

The test time is of 28 days, having care never to agitate the solution.

At the end of this time period, each specimen was submitted to the peeling test, having care to uncover and measure the detached circular region.

The test results are reported in Table 3, together with the results from Examples 34 and 35, wherein either zeolite in absent, or the boron-silanizing treatment was omitted.

TABLE 3

TESTS ON RESISTANCE TO CATHODIC DETACHMENT OF POLYTHENE-COATED STEEL SPECIMENS

| | Specimen: Reference Example | Adhesive Mass (Example) | Boron-Silanizing Solution (Example) | Duration of the Cathodic Protection (days) | Detached Surface Area ($mm^2$) |
|---|---|---|---|---|---|
| EXAMPLE 31 | 16 | 2 | 11 | 28 | 400 |
| EXAMPLE 32 | 17 | 2 | 12 | 28 | 350 |
| EXAMPLE 33 | 20 | 5 | 10 | 28 | 380 |
| EXAMPLE 34 | 24 | 7 | 12 | 7 | Larger than 5,000 |
| EXAMPLE 35 | 23 | 2 | none | 7 | Larger than 5,000 |

We claim:

1. Process for applying a polyolefin-resin layer to a metallic surface, carried out in succession:

(a) mechanical cleaning of the metal surfaces;

(b) treatment of the metal surface with a water-alcoholic solution containing boric acid, and at least an alkoxy-silane having the formula:

$$R_n—Si(OR^1)_m$$

wherein:

$R^1$ is a linear or branched alkyl radical containing from 1 to 4 carbon atoms, R is a linear or branched, saturated or unsaturated, possibly substituted hydrocarbon radical containing from 1 to 5 carbon atoms $m+n=4$, and m is always different from zero;

(c) thermal treatment of the so treated surface, wherein said thermal treatment takes place at a temperature comprised within the range of from 60° to 250° C., for a time of from 1 minute to 2 hours;

(d) coating of the metal surface with a polyolefin-based composition, containing zeolites and carbon black.

2. Process according to claim 1, characterized in that in the (a) step the mechanical cleaning treatment is continued until a metal surface is obtained, which has a finishing degree of at least SA2 1/2, according to SVENSK Standard SIS 055900 (1967).

3. Process according to claim 1, characterized in that the metal surface is either iron or steel.

4. Process according to claim 1, characterized in that the alcohol used in the solution of the (b) step is either ethanol or methanol.

5. Process according to claim 1, characterized in that the boric acid in the (b) step is present in an amount comprised within the range of from 1% by weight to the amount allowed by the solubility limit.

6. Process according to claim 5, characterized in that boric acid is contained in an amount comprised within the range of from 1% to 4.8% by weight.

7. Process according to claim 1, characterized in that in the (b) step the alkoxy-silane is selected from the group consisting of tetra-ethoxy-silane, tri-ethoxy-vinyl-silane and tri-methoxy-methyl-silane.

8. Process according to claim 7, characterized in that the alkoxy-silane is tetra-ethoxy-silane.

9. Process according to claim 1, characterized in that in the (b) step the alkoxy-silane is present in the solution in an amount comprised within the range of from 2% to 20% by weight.

10. Process according to claim 9, characterized in that the alkoxy-silane is present in an amount comprised within the range of from 2% to 5% by weight.

11. Process according to claim 1, characterized in that in the (b) step the B/Si molar ratio in the solution is comprised within the range of from 1/1 to 3/1.

12. Process according to claim 1, characterized in that in the (b) step the pH value of the solution is comprised within the range of from 3 to 7.

13. Process according to claim 12, characterized in that the pH value is comprised within the range of from 5 to 6.

14. Process according to claim 1, characterized in that in the (b) step the solution is left to age for a time comprised within 0.5 to 3 hours, and the metal surface is then wetted with said solution by means of dip-wetting or spray-wetting.

15. Process according to claim 14, characterized in that the solution is left to age for a time comprised within the range of from 1 to 2 hours.

16. Process according to claim 1, characterized in that in the (c) step the surface wetted with the solution from the (b) step is heated to a temperature comprised within the range of from 120° to 180° C. for a heating time comprised within the range of from 5 to 60 minutes.

17. Process according to claim 1, characterized in that in the (d) step a polyethylene-based polymeric composition is used.

18. Process according to claim 17, characterized in that low-density polyethylene is used.

19. Process according to claim 1, characterized in that in the (d) step the polymeric composition comprises from 0.1% to 40% by weight of zeolites, and from 0 to 6% by weight of carbon black.

20. Process according to claim 19, characterized in that the polymeric composition comprises from 4% to 10% by weight of zeolite, and from 1.8 to 3.5% by weight of carbon black, in case it is used for protective coatings, or it comprises from 4% to 40% by weight of zeolites, and from 3 to 6% by weight of carbon black, in case it is used as a structural adhesive.

21. Process according to claim 1, characterized in that the zeolites contained in the polymeric composition of the (d) step contain a water amount not larger than 8% by weight, and have a granulometry not larger than 4 microns.

22. Process according to claim 1, characterized in that in the (d) step the polymeric composition contains zeolites selected from the group consisting of: zeolites of "X" type, zeolites of "Y" type, zeolites of "A" type, zeolites of Mordenite type, and zeolites of ZSM type.

23. Process according to claim 22, characterized in that the zeolites are of "13X" or "4A" type.

24. Process according to claim 1, characterized in that the (d) step, the metal surface is coated with the polymeric composition by means of extrusion-coating wherein the coating applied comprises a thickness within the range of from 2 to 4 mm, or by lamination wherein the coating applied comprises a thickness within the range of from 0.2 to 4mm.

* * * * *